US007647142B2

(12) United States Patent
Desanzo

(10) Patent No.: US 7,647,142 B2
(45) Date of Patent: Jan. 12, 2010

(54) SYSTEM, METHOD AND COMPUTER READABLE MEDIA FOR REGULATING THE SPEED OF A RAIL VEHICLE

(75) Inventor: David Joseph Desanzo, Waterford, PA (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 12/046,678

(22) Filed: Mar. 12, 2008

(65) Prior Publication Data

US 2009/0234522 A1 Sep. 17, 2009

(51) Int. Cl.
*G05D 1/00* (2006.01)

(52) U.S. Cl. ..... 701/20

(58) Field of Classification Search ..... 701/1, 701/19, 20, 24; 340/425.5, 438, 441, 449, 340/901, 905; 180/271, 275

See application file for complete search history.

(56) References Cited

U.S. PATENT DOCUMENTS

| | | | | |
|---|---|---|---|---|
| 4,114,442 | A | 9/1978 | Pratt | |
| 5,161,891 | A | 11/1992 | Austill | |
| 5,446,452 | A | 8/1995 | Litton | |
| 7,147,169 | B2 | 12/2006 | Walsh | |
| 2002/0075141 | A1 * | 6/2002 | Lang et al. | 340/438 |
| 2002/0077733 | A1 * | 6/2002 | Bidaud | 701/19 |

* cited by examiner

*Primary Examiner*—Kim T Nguyen
(74) *Attorney, Agent, or Firm*—Robert Wawrzyn, Esq.; Cian G. O'Brien, Esq.; Beusse Wolter Sanks Mora & Maire, P.A.

(57) ABSTRACT

A system is provided for regulating the speed of a rail vehicle traveling along a track. The track has a pair of rails. The system includes a temperature sensor positioned on an external surface of the rail vehicle. The temperature sensor measures a temperature of one of the rails. The system further includes a controller coupled to the temperature sensor. The controller receives data of the measured temperature, and regulates the speed of the rail vehicle based upon the measured temperature data. A method and computer readable media are also provided for regulating the speed of a rail vehicle traveling along a track.

15 Claims, 3 Drawing Sheets

SYSTEM, METHOD AND COMPUTER READABLE MEDIA FOR REGULATING THE SPEED OF A RAIL VEHICLE

BACKGROUND OF THE INVENTION

A locomotive which travels over the rails of a track may experience different rail temperatures as the locomotive travels along the track. For example, the locomotive may travel over rails having an extremely low rail temperature which may cause the rails to crack or pull apart, resulting in a possible safety hazard. In another example, the locomotive may travel over rails having an extremely high rail temperature which may cause the rails to buckle, resulting in another possible safety hazard. In such instances of an extremely low or an extremely high rail temperature, the locomotive speed needs to be adjusted accordingly, to minimize the risk of such safety hazards.

Several conventional systems have been suggested to monitor the temperature of the rails of a track. These conventional systems may warn a locomotive operator if the locomotive is traveling over a rail having an unsafe temperature, for example. However, such conventional systems measure an ambient air temperature at a location and utilize this ambient air temperature measurement to project whether the rails have an extremely high or an extremely low temperature. Additionally, when deciding whether the rail temperature has returned to a safe level, and to lift an issued warning to a locomotive operator, the conventional systems typically do not utilize ambient air temperature, but instead a daytime event such as sunset, for example. Additionally, these conventional systems typically measure the ambient air temperature at one location, but use this measurement to project the rail temperature over a significant geographic area and multiple regions of the track beyond the location of the ambient air temperature measurement.

Thus, these conventional systems are inherently limited in their ability to minimize the number of instances and locations of issued warnings to locomotive operators of unsafe rail temperatures. Accordingly, it would be advantageous to provide a system capable of minimizing the number of instances and locations of issued warnings to the locomotive operators, and a system to correspondingly regulate the locomotive speed during such warnings.

BRIEF DESCRIPTION OF THE INVENTION

In one embodiment of the present invention, a system is provided for regulating the speed of a rail vehicle traveling along a track. The track has a pair of rails. The system includes a temperature sensor positioned on an external surface of the rail vehicle. The temperature sensor measures a temperature of one of the rails. The system further includes a controller coupled to the temperature sensor. The controller receives data of the measured temperature, and regulates the speed of the rail vehicle based upon the measured temperature data.

In another embodiment of the present invention, a method is provided for regulating the speed of a rail vehicle traveling along a track. The track has a pair of rails. The method includes positioning a temperature sensor on an external surface of the rail vehicle. The method further includes configuring the temperature sensor to measure a temperature of one of the rails. The method further includes configuring a controller coupled to the temperature sensor to receive data of the measured temperature. The method further includes regulating the speed of the rail vehicle based upon the measured temperature data.

In another embodiment of the present invention, computer readable media is provided for regulating the speed of a rail vehicle traveling along a track. The track has a pair of rails. A temperature sensor is positioned on an external surface of the rail vehicle. The temperature sensor measures a temperature of one of the rails. A controller is coupled to the temperature sensor, and receives data of the measured temperature. The computer readable media includes a computer program code for regulating the speed of the rail vehicle based upon the measured temperature data.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
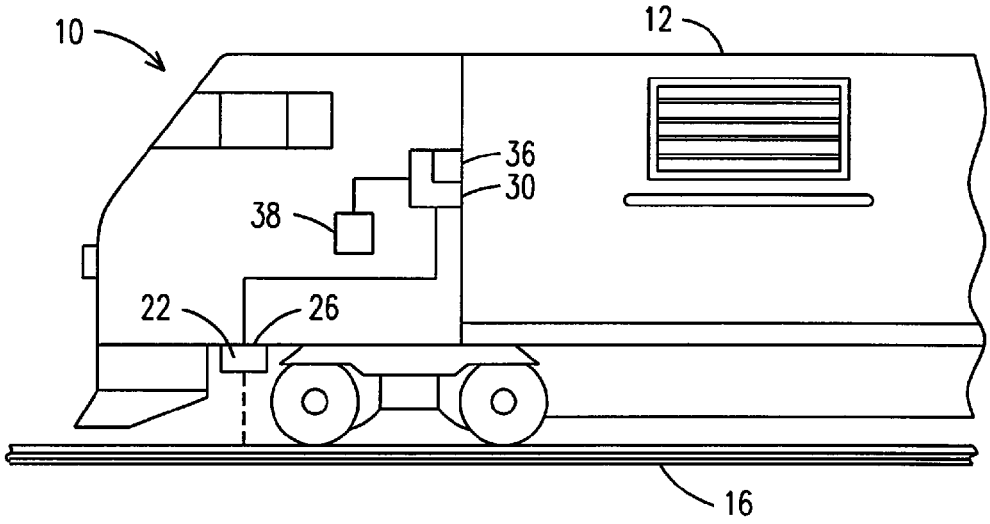
FIG. 1 is a side plan view of one embodiment of a system for regulating the speed of a rail vehicle traveling along a track.
Figure 2:
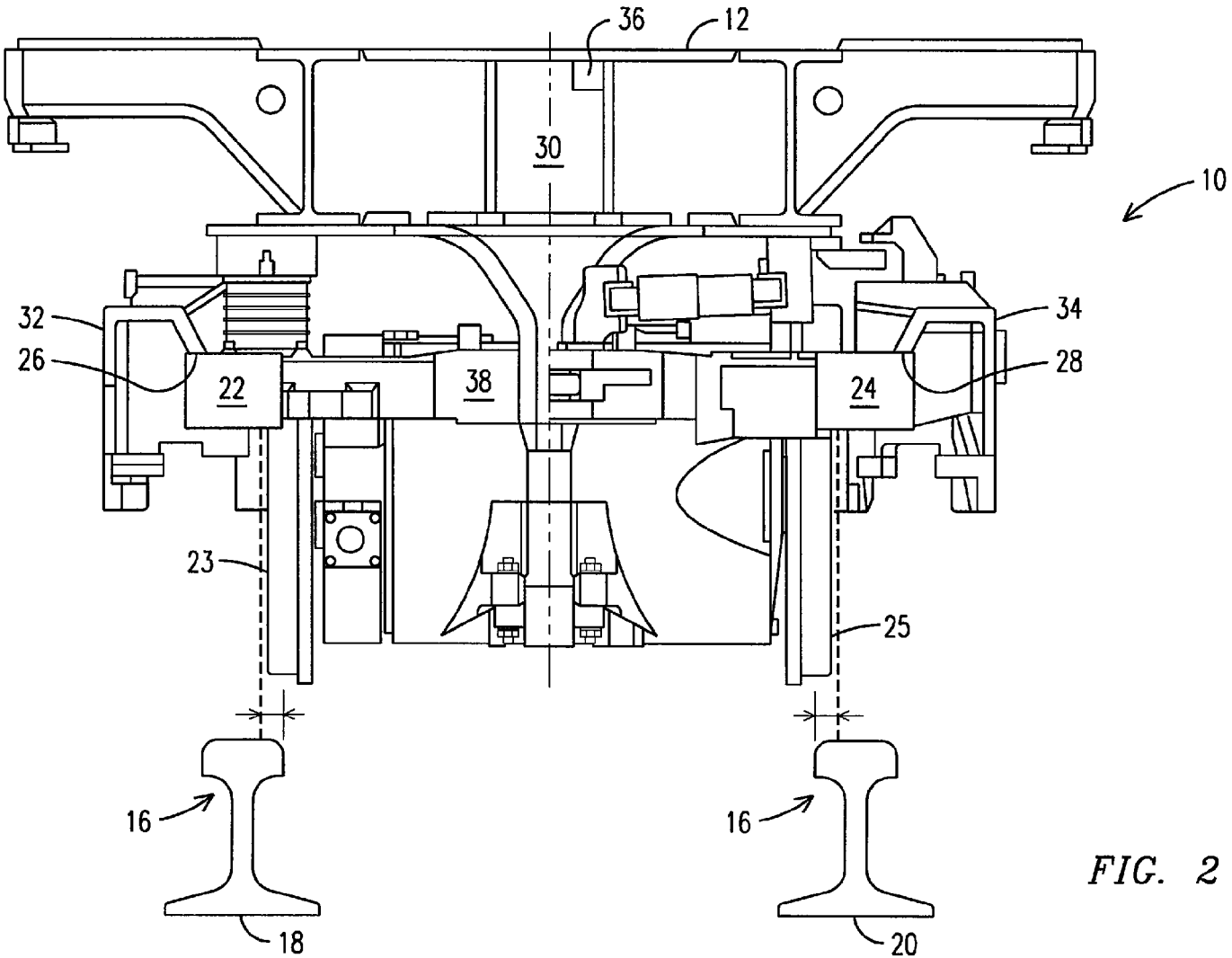
FIG. 2 is a front plan view of one embodiment of a system for regulating the speed of a rail vehicle traveling along a track.

FIG. 1 illustrates an exemplary embodiment of a system 10 for regulating the speed of a front locomotive 12 of a train traveling along a track 16 having a pair of rails 18,20 (FIG. 2). Although FIG. 1 illustrates a front locomotive 12 of a train, any front rail vehicle may be utilized with the embodiments of the system 10 in accordance with the present invention. Front rail vehicles are advantageous for the embodiments of the system in accordance with the present invention, as the present invention is concerned with measuring the temperature of the rails 18,20, and a front rail vehicle is not preceded by a rail vehicle which may undesirably heat the rails prior to a temperature measurement.

As illustrated in the exemplary embodiment of FIG. 2, a pair of temperature sensors 22,24 are positioned on a pair of respective external surfaces 26,28 of the front locomotive 12. The pair of temperature sensors 22,24 are positioned on a respective external surface 26,28, which is a respective undersurface of opposing sides 32,34, of the front locomotive 12. As illustrated in the exemplary embodiment of FIG. 2, the respective external surfaces 26,28 which are the respective undersurfaces of the opposing sides 32,34 are selected such that the temperature sensors 22,24 are positioned above the respective pair of rails 18,20. In an exemplary embodiment, the temperature sensors 22,24 are infrared sensors which are laterally aligned with the respective rails 18,20. An infrared signal 23,25 is received from the respective rails 18,20 to the infrared sensors. Using the infrared signal 23,25 received from the respective rails 18,20, the infrared sensor measures the temperature of the respective rails 18,20 based on an infrared spectrum of the respective rails 18,20. Although FIG. 2 illustrates a pair of temperature sensors 22,24 positioned above a respective pair of rails 18,20, less or more than two temperature sensors may be utilized in the embodiments of the present invention. Additionally, although the temperature sensors 22,24 are positioned on respective external surfaces 26,28 of the front locomotive 12, such temperature sensors may be internally mounted within the front locomotive 12, and receive the necessary data to determine the rail temperature from outside the front locomotive 12, for example.

As discussed above, the temperature sensors 22,24 measure a temperature of a respective rail 18,20. Additionally, the system 10 includes a controller 30 coupled to the temperature sensor 22,24. The controller 30 is configured to receive data of the measured temperature from the temperature sensors 22,24. Additionally, the controller 30 is configured to regulate the speed of the front locomotive 12 based upon the measured temperature data received from the temperature sensors 22,24. In an exemplary embodiment, where the pair of temperature sensors 22,24 are a pair of infrared sensors, as discussed above, the controller 30 is configured to receive the measured temperature data from the pair of infrared sensors. Upon receiving the measured temperature data from the pair of infrared sensors, the controller 30 is configured to determine a maximum allowable speed of the front locomotive 12 based on the measured temperature data. The maximum allowable speed, along with its corresponding measured temperature data, are stored in a memory 36 of the controller 30. For example, if the infrared sensors provide measured temperature data of 5 degrees Celsius to the controller 30, the controller 30 then searches the memory 36 and determines that the maximum allowable speed is 30 miles per hour corresponding to a measured temperature data of 5 degrees Celsius. Thus, the memory 36 has a pre-stored table for the maximum allowable speed for the front locomotive 12 corresponding to all measured temperature data, provided that the measured temperature data qualifies as an unsafe or extreme temperature. For example, if the infrared sensors provide measured temperature data of 26 degrees Celsius to the controller 30, and the controller 30 then searches the memory 36, which contains no maximum allowable speed entry corresponding to 26 degrees Celsius, or indicates that 26 degrees Celsius is not an extreme/unsafe temperature, then the controller 30 will not regulate the speed of the front locomotive 12, and continue to monitor the measured temperature data. Although the exemplary embodiments of the present invention discussed above disclose that the temperature sensors 22,24 determine the temperature of the rails 18,20 and transmit this temperature data to the controller 30, the temperature sensors may merely transmit data to the controller 30 which is processed by the controller 30 to determine the temperature of the rails 18,20, for example.

As further illustrated in the exemplary embodiment of FIGS. 1-2, the controller 30 is coupled to a speed sensor 38 positioned within the front locomotive 12. The speed sensor 38 is configured to measure the speed of the front locomotive 12, and transmit data of the speed of the front locomotive 12 to the controller 30. The controller 30 is configured to reduce the speed of the front locomotive 12 to the maximum allowable speed if the speed of the front locomotive 12 is greater than the maximum allowable speed of the front locomotive. As discussed above, if the measured temperature data does not have an associated maximum allowable speed or the measured temperature data is not an extreme/unsafe temperature, the controller 30 does not regulate or reduce the speed of the front locomotive 12.

Figure 3:
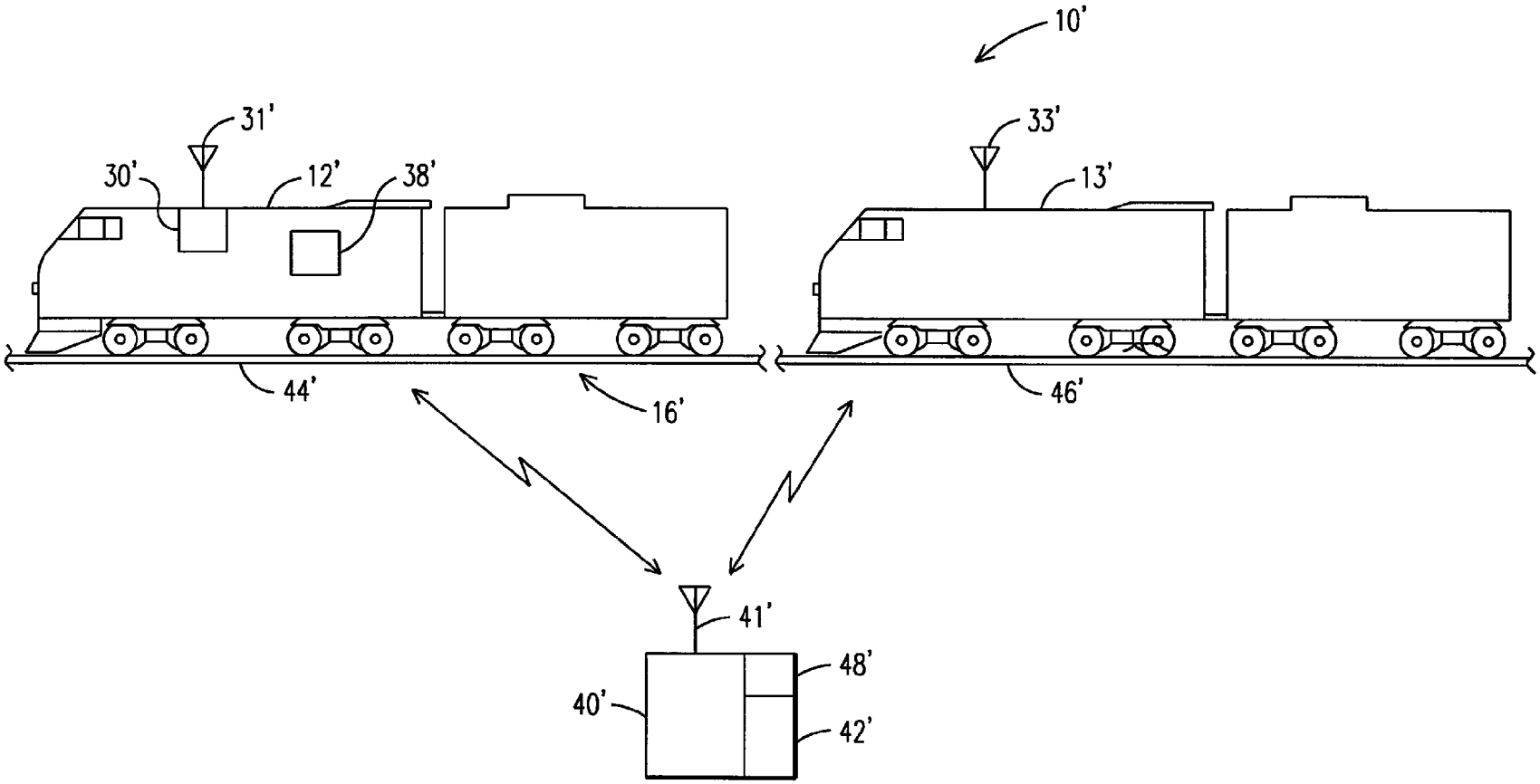
FIG. 3 is a schematic view of one embodiment of a system for regulating the speed of a plurality of rail vehicles traveling along a respective plurality of regions of a track.

As illustrated in the exemplary embodiment of the system 10' in FIG. 3, the controller 30' of the front locomotive 12' is coupled to a transceiver 31'. The controller 30' is configured to communicate the received measured temperature data to the transceiver 31' to transmit the received measured temperature data to a transceiver 41' coupled to a remote facility 40'. The transceiver 41' of the remote facility 40' is coupled to a processor 42' within the remote facility 40'. The remote facility processor 42' is configured to collect the measured temperature data from a plurality of front locomotives 12',13' traveling along a plurality of regions 44',46' along the track 16'. Thus, the remote facility processor 42' receives measured temperature data from a number of regions along the track, and thus can then determine which particular regions among all of the regions of the track have unsafe/extreme rail temperatures which require controlling the maximum speed of the locomotives in those particular regions. The remote facility 40' may be located at any relative location in relation to the track 16', and may house a monitoring center, for example, to continuously monitor the measured rail temperature of the rails, in real-time, for example. However, the remote facility 40' will only receive such real-time data of measured rail temperature based on the number of front locomotives 12', 13', and the operating characteristics of the temperature sensors, for example.

The remote facility processor 42' is configured to evaluate the measured temperature data along the plurality of regions 44',46' of the track 16'. The remote facility processor 42' is configured to determine a respective maximum allowable speed of the plurality of front locomotives 12',13' traveling along the respective plurality of regions 44',46' of the track 16', based on the respective measured temperature data along the respective plurality of regions 44',46'. Thus, this embodiment of the system 10', in which the remote facility processor 42' determines the maximum allowable speed for the front locomotives 12',13', varies from those embodiments of the system 10 discussed above, in which the controller 30 determines the maximum allowable speed of the front locomotive 12. The respective maximum allowable speed of the plurality of regions 44',46' for the measured temperature data is stored in a memory 48' of the remote facility processor 42'. The remote facility processor 42' is configured to communicate the respective maximum allowable speed for the plurality of regions 44',46' to the transceiver 41', which transmits the respective maximum allowable speed to the transceivers 31', 33' of the respective plurality of front locomotives 12',13' in the plurality of regions 44',46'. The controller 30' of the front locomotive 12' is configured to receive the maximum allowable speed data from the transceiver 31' and the remote facility processor 42'. The controller 30' is coupled to a speed sensor 38' of the front locomotive 12' to receive data of the speed of the front locomotive 12'. The controller 30' is configured to reduce the speed of the front locomotive 12' to the maximum allowable speed if the speed of the front locomotive 12' is greater than the maximum allowable speed of the front locomotive 12'. In an exemplary embodiment, the front locomotives 12',13' transmit measured rail temperatures of the respective regions 44',46' of the track 16' to the remote facility processor 42' of 5 degrees Celsius and 26 degrees Celsius, respectively. In the exemplary embodiment, the remote facility processor 42' searches the memory 48' and determines that the region 44' of the track 16' will have a maximum allowable speed of 30 miles per hour, while the region 46' of the track 16' will not have a maximum allowable speed. Thus, in the exemplary embodiment, the remote facility processor 42' effectively localizes a maximum allowable speed warning to less than all regions 44',46' of the track 16'. Those elements of the system 10' not discussed herein, are similar to those elements of the system 10 discussed above, with prime notation, and require no further discussion herein.

Figure 4:
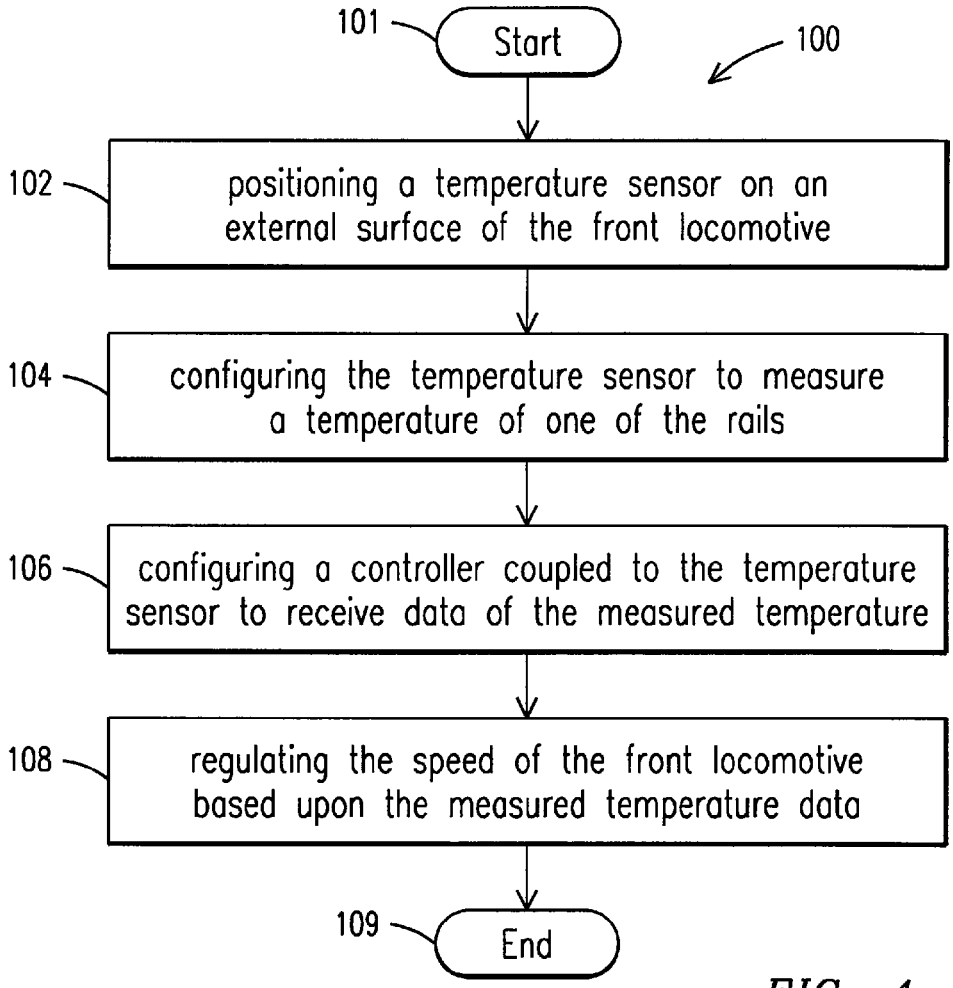
FIG. 4 is a flow chart illustrating an exemplary embodiment of a method for regulating the speed of a rail vehicle traveling along a track.

FIG. 4 illustrates an exemplary embodiment of a flow chart depicting a method 100 for regulating the speed of a front locomotive 12 traveling along a track 16. The track 16 has a pair of rails 18, 20. The method 100 begins at 101 by positioning 102 a temperature sensor 22,24 on an external surface 26,28 of the front locomotive 12. The method 100 further includes configuring 104 the temperature sensor 22,24 to measure a temperature of one of the rails 18,20. The method 100 further includes configuring 106 a controller 30 coupled to the temperature sensor 22,24 to receive data of the measured temperature. The method 100 further includes regulating 108 the speed of the front locomotive 12 based upon the measured temperature data, before ending at 109.

Based on the foregoing specification, the above-discussed embodiments of the invention may be implemented using computer programming or engineering techniques including computer software, firmware, hardware or any combination or subset thereof, wherein a technical effect is to regulate the speed of a rail vehicle traveling along a track. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any emitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for regulating the speed of a rail vehicle traveling along a track, said track having a pair of rails, said system comprising:

a pair of temperature sensors positioned on an external surface of said rail vehicle, said pair of temperature sensors being configured to measure a temperature of said rails;

a controller coupled to said pair of temperature sensors, said controller being configured to receive data of said measured temperature, said controller being configured to regulate said speed of the rail vehicle based upon said measured temperature data;

wherein the rail vehicle is front locomotive of a train; and wherein said pair of temperature sensors are positioned on an undersurface of opposing sides of the front locomotive, said undersurface of said opposing sides is selected such that said pair of temperature sensors are positioned above said respective pair of rails.

2. The system of claim 1, wherein said pair of temperature sensors is a pair of infrared sensors aligned with said respective rails, said infrared sensors being configured to measure said temperature of said respective rails based on an infrared spectrum of said respective rails received from said respective rails.

3. The system of claim 2, wherein said controller is configured to receive said measured temperature data of said respective rails from said pair of infrared sensors, said controller is configured to determine a maximum allowable speed of said front locomotive based on said measured temperature data of said respective rails, said maximum allowable speed based on said measured temperature data of said respective rails being stored in a memory of said controller.

4. The system of claim 3, wherein said controller is coupled to a speed sensor of said front locomotive to receive data of said speed of the front locomotive, said controller is configured to reduce said speed of the front locomotive to said maximum allowable speed if said speed of the front locomotive is greater than said maximum allowable speed of the front locomotive.

5. The system of claim 2, said controller is configured to transmit said received measured temperature data of said respective rails to a remote facility having a processor, said remote facility processor being configured to collect said measured temperature data of said respective rails from a plurality of locomotives traveling along a plurality of regions along said track.

6. The system of claim 5, wherein said remote facility processor is configured to evaluate said measured temperature data of said respective rails along said plurality of regions of said track, said remote facility processor is configured to determine a respective maximum allowable speed of said plurality of locomotives traveling along said respective plurality of regions of said track.

7. The system of claim 6, wherein said respective maximum allowable speed of said plurality of regions based on said measured temperature data of said respective rails is stored in a memory of said remote facility processor; said remote facility processor is configured to transmit said respective maximum allowable speed to said plurality of locomotives in said plurality of regions.

8. The system of claim 7, wherein said controller is configured to receive said maximum allowable speed data from said remote facility processor, said controller is coupled to a speed sensor of the front locomotive to receive data of said speed of the front locomotive, said controller is configured to reduce said speed of the front locomotive to said maximum allowable speed if said speed of the front locomotive is greater than said maximum allowable speed of the front locomotive.

9. A method for regulating the speed of a rail vehicle traveling along a track, said track having a pair of rails, said method comprising:

positioning a pair of temperature sensors on an external surface of said rail vehicle;

configuring said pair of temperature sensors to measure a temperature of one of said rails;

configuring a controller coupled to said pair of temperature sensors to receive data of said measured temperature;

regulating said speed of the rail vehicle based upon said measured temperature data;

wherein said rail vehicle is front locomotive of a train; and wherein said pair of temperature sensors are positioned on an undersurface of opposing sides of the front locomotive, said undersurface of said opposing sides is selected such that said pair of temperature sensors are positioned above said respective pair of rails.

10. The method of claim 9, wherein said pair of temperature sensors is a pair of infrared sensors, said method further comprising:

aligning said pair of infrared sensors with said respective rails; and configuring said infrared sensors to measure said temperature of said respective rails based on an infrared spectrum of said respective rails received from said respective rails.

11. The method of claim 10, further comprising:

determining a maximum allowable speed of said front locomotive based on said measured temperature data of said respective rails, said maximum allowable speed based on said measured temperature data of said respective rails being stored in a memory of said controller.

12. The method of claim 11, further comprising:

coupling said controller to a speed sensor of said front locomotive to receive data of said speed of the front locomotive; and reducing said speed of the front locomotive to said maximum allowable speed if said speed of the front locomotive is greater than said maximum allowable speed of the front locomotive.

13. The method of claim 10, further comprising:

transmitting said received measured temperature data of said respective rails to a remote facility having a processor; and collecting said measured temperature data of said respective rails from a plurality of locomotives traveling along a plurality of regions along said track at said remote facility.

14. The method of claim 13, further comprising:

evaluating said measured temperature data of said respective rails along said plurality of regions of said track; and determining a respective maximum allowable speed of said plurality of locomotives traveling along said respective plurality of regions of said track.

15. The method of claim 14, further comprising:

storing said respective maximum allowable speed of said plurality of regions in a memory of said remote facility processor based on said respective measured temperature data of said respective rails from said plurality of regions; and transmitting said respective maximum allowable speed to said plurality of locomotives in said plurality of regions.

* * * * *